US010083590B1

(12) United States Patent
Movsisyan et al.

(10) Patent No.: US 10,083,590 B1
(45) Date of Patent: Sep. 25, 2018

(54) ENCOURAGING ALERT RESPONSIVENESS

(71) Applicant: VMware, Inc., Palo Alto, CA (US)

(72) Inventors: Vardan Movsisyan, Yerevan (AR); Steven Flanders, Nashua, NH (US)

(73) Assignee: VMware, Inc., Palo Alto, CA (US)

( * ) Notice: Subject to any disclaimer, the term of this patent is extended or adjusted under 35 U.S.C. 154(b) by 0 days.

(21) Appl. No.: 15/587,451

(22) Filed: May 5, 2017

(51) Int. Cl.
*G08B 23/00* (2006.01)
*G08B 21/04* (2006.01)

(52) U.S. Cl.
CPC ..... *G08B 21/0415* (2013.01)

(58) Field of Classification Search
CPC ..... G08B 21/0415
See application file for complete search history.

(56) References Cited

U.S. PATENT DOCUMENTS 5,902,234 A * 5/1999 Webb ..... A61B 5/0002 600/300
6,798,780 B1 * 9/2004 Dan ..... H04L 12/2854 370/216
8,274,360 B2 * 9/2012 Sampath ..... G16H 10/60 340/3.3
8,280,364 B1 * 10/2012 Sennett ..... H04W 4/90 455/419
8,310,336 B2 * 11/2012 Muhsin ..... G06F 17/30516 340/3.3
8,645,516 B2 * 2/2014 Bechtel ..... G06F 17/30994 709/203
9,098,604 B2 * 8/2015 Treacy ..... G06Q 10/10
9,111,430 B2 * 8/2015 Kraus ..... G08B 25/005
9,213,061 B2 * 12/2015 Whetsel ..... G01R 31/3172
9,721,456 B2 * 8/2017 Thurlow ..... H04W 4/90
2002/0002633 A1 * 1/2002 Coiling, III ..... G06F 9/542 719/318
2002/0169895 A1 * 11/2002 Anand ..... G06Q 10/10 719/313
2003/0167202 A1 * 9/2003 Marks ..... G06Q 30/02 705/14.69
2004/0070515 A1 * 4/2004 Burkley ..... G01S 5/0027 340/8.1

(Continued)

FOREIGN PATENT DOCUMENTS

WO WO 2013057578 A2 * 4/2013 ..... G01S 1/042

*Primary Examiner* — Joseph Feild
*Assistant Examiner* — Rufus Point
(74) *Attorney, Agent, or Firm* — Clayton, McKay & Bailey, PC

(57) ABSTRACT

The present disclosure is related to methods, systems, and devices for encouraging alert responsiveness. An example device can include instructions executed to receive an alert message via a monitoring server, wherein the alert message indicates an alert instance, communicate the alert message to a plurality of alert responders, determine that a non-responsiveness, corresponding to the alert message, of a particular alert responder exceeds a threshold, receive a subsequent alert message via the monitoring server, wherein the subsequent alert message indicates a subsequent alert instance and communicate the subsequent alert message to the particular alert responder having the threshold-exceeding non-responsiveness, wherein the communication of the subsequent alert message includes a response encouragement.

21 Claims, 5 Drawing Sheets

(56) References Cited

U.S. PATENT DOCUMENTS

2005/0096805 A1* 5/2005 Fudali ..... G07C 5/008 701/31.4
2006/0101139 A1* 5/2006 Hornreich ..... G06Q 10/10 709/224
2007/0222640 A1* 9/2007 Guelzow, II ..... G08B 5/006 340/908
2008/0077326 A1* 3/2008 Funk ..... G01C 21/165 701/500
2008/0146895 A1* 6/2008 Olson ..... G08B 21/0453 600/301
2009/0043504 A1* 2/2009 Bandyopadhyay .... G01C 17/38 701/469
2009/0045942 A1* 2/2009 Schurter ..... A62C 99/00 340/539.11
2009/0125601 A1* 5/2009 Braam ..... G06Q 10/107 709/207
2012/0322402 A1* 12/2012 Sennett ..... H04W 4/90 455/404.1
2013/0162424 A1* 6/2013 Treacy ..... G06Q 10/10 340/502
2013/0165153 A1* 6/2013 Turk ..... H04W 76/50 455/456.3
2013/0167244 A1* 6/2013 Turk ..... G06Q 10/00 726/26
2015/0111559 A1* 4/2015 Leaver ..... H04W 8/22 455/418
2015/0116112 A1* 4/2015 Flinsenberg ..... G16H 40/20 340/539.11
2015/0289122 A1* 10/2015 Friesen ..... H04W 4/02 455/404.2
2015/0302726 A1* 10/2015 Treacy ..... G06Q 10/10 340/502
2017/0140637 A1* 5/2017 Thurlow ..... H04W 4/90
2017/0251347 A1* 8/2017 Mehta ..... H04W 4/90
2017/0265045 A1* 9/2017 Igumnov ..... H04W 4/90

* cited by examiner

564

ALERTS / INCIDENTS

BUTTONS: | RESOLVE | ACKNOWLEDGE | SNOOZE | REASSIGN | SHOW: | ALL | OPEN | ACKNOWLEDGED | RESOLVED |

| | OPENED ON | STATUS | DOMAIN | DETAILS | TYPE | DURATION | ASSIGNED TO |
|---|---|---|---|---|---|---|---|
| 566-1 | 2345-12-31 23:59:00 | ACKNOWLEDGED | WEB SERVERS | ERROR ON MAIN WEBSITE | PHP ERROR1 | 2 HOURS | RESPONSIVE A |
| 566-2 | 2345-12-31 21:59:00 | OPEN | WEB SERVERS | ERROR ON MAIN WEBSITE | PHP ERROR2 | 4 HOURS | NON-RESPONSIVE B |
| | 2345-12-31 19:59:00 | ACKNOWLEDGED | WEB SERVERS | ERROR ON PROD2 WEBSITE | PHP ERROR3 | 6 HOURS | RESPONSIVE A |
| 566-3 | 2345-12-31 11:59:00 | RESOLVED | WEB SERVERS | ERROR ON MAIN WEBSITE | PHP ERROR2 | 12 HOURS | RE: RESPONSIVE A |
| | 2345-12-30 19:59:00 | RESOLVED | WEB SERVERS | ERROR ON PROD1 WEBSITE | PHP ERROR1 | 28 HOURS | NON-RESPONSIVE B |
| | 570 | 568 | 574 | 572 | 573 | 578 | 576 |

*Fig. 5*

ENCOURAGING ALERT RESPONSIVENESS

BACKGROUND

Alerts can communicate events that may call for human involvement. In some cases, more than one person may be tasked with resolving and/or responding to alerts during a time period (e.g., a shift). When multiple people receive alerts, those having a tendency to be less responsive to alerts may shift the burden of responding to other people. Stated differently, the inaction of some alert responders can punish other alert responders. For example, if an alert responder responds to an alert, they may receive future notifications (e.g., action items) related to that alert; if an alert responder does not respond to an alert, they may avoid receiving future notifications related to that alert. Such a situation may frustrate diligent, responsive, alert responders and simultaneously encourage further non-responsiveness in their non-responsive counterparts.

BRIEF DESCRIPTION OF THE DRAWINGS

FIG. 5 is an interface associated with encouraging alert responsiveness according to the present disclosure.

DETAILED DESCRIPTION

Figure 1:
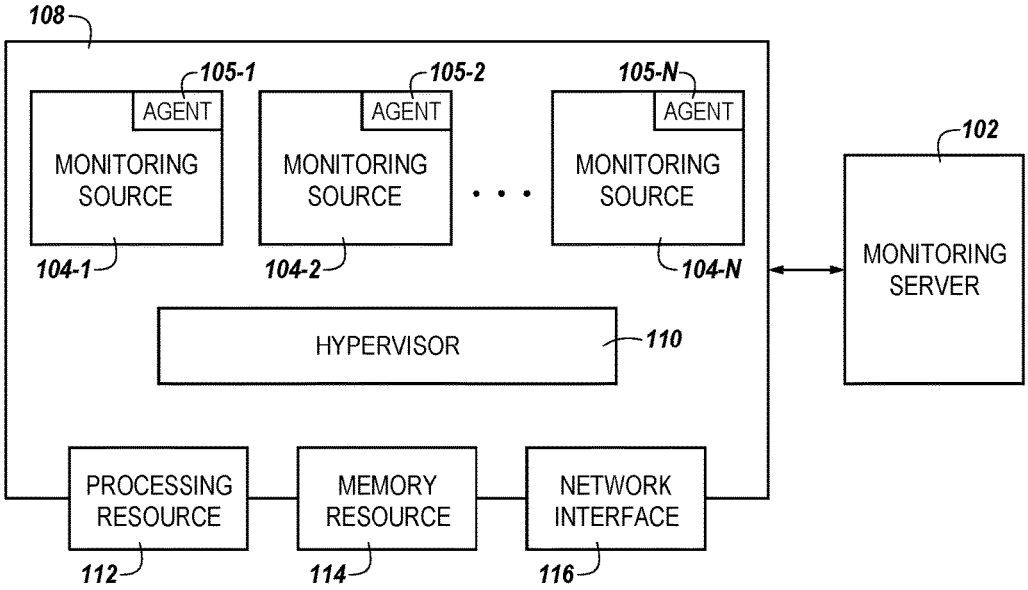
FIG. 1 is a diagram of an example of an infrastructure for encouraging alert responsiveness according to the present disclosure.

A monitoring source, as used herein, refers to a source of one or more system logs (e.g., event and/or status logs). In general, a monitoring source can refer to any entity capable of generating logs (e.g., unstructured logs). For instance, a monitoring source can be a server (e.g., a physical server), a virtual computing instance, an application, a host, a network device, a desktop computing device, an event channel, a log aggregator, a log file, etc. A monitoring server can monitor logs of, and/or configure, one or more monitoring sources. Where the term "log" is used herein, it is noted that embodiments of the present disclosure are not so limited. For instance, a monitoring server can monitor data such as net data, billing data, etc. Alerts can be generated for one or more monitoring sources. The monitoring server can receive, retrieve, store, and/or display alerts. In some embodiments, the monitoring server can outsource one or more aspects of receiving, retrieving, storing, and/or displaying alerts to other entities.

As discussed further below, a single instance of an alert is herein referred to as an "alert instance." An alert instance can be particular to a class of alerts. In some embodiments, each alert instance can belong to a particular class. As used herein, "class" refers to a type of one or more alert instances. Stated in other terms, an alert definition may be referred to as a class of alerts, while each triggered specific alert may be referred to as an "alert instance." In an example, a class of alerts can be defined as alerts triggered if during the last five minutes more than ten messages from an httpd application contain the keyword "error." An alert instance of that example class of alerts can be an alert triggered on 2045-12-31 12:34:56 for monitoring source 1.2.3.4.

In some embodiments, an alert instance can be indicated by an alert message. In some embodiments, an alert message can indicate a plurality of alert instances. When a user, such as a system administrator, is provided with an alert message (sometimes referred to simply as an "alert"), he or she may attempt to respond to the alert (e.g., resolve the problem indicated by the alert message). Users tasked with receiving and responding to alert messages are herein referred to as "alert responders." In some embodiments, alert responders may be employees or owners of an entity, such as a corporation. In some embodiments, alert responders may be applications and/or software agents. Alert responders may be "on call" for a particular period of time during which they are tasked with responding to received alert messages. For example, an alert message may be communicated to each of a plurality of alert responders. In theory, the alert responder (s) having the time and/or technical ability to best respond to the alert message will respond. Over time, and over a number of alert instances of different types, the relative quantities of alert instances responded to by each alert responder should theoretically regress to a mean.

However, when more than one alert responder is on call, there may be a tendency for one or more alert responders to shirk their duty to respond to alert messages in a timely or quality manner. Whether such a result is due to the "bystander effect" phenomenon, because these alert responders are actively avoiding their duties, or some other reason may mean little to the responsive alert responders who are burdened with the extra load.

These "non-responsive" alert responders may tend to ignore alert messages altogether, "snooze" alert messages until the end of their shift, reassign or delegate an alert message to another alert responder, or simply close an alert message without troubleshooting or adding notes to help future on-call alert responders. Embodiments of the present disclosure can encourage responsiveness by these alert responders. Non-responsiveness in alert responders is not limited to those working as one of a plurality (e.g., groups, teams, etc.) of alert responders. When a single alert responder is on duty they may be encouraged to be responsive by embodiments herein. Stated differently, embodiments herein are applicable to groups of alert responders and to single alert responders.

In some embodiments, for example, non-responsive alert responders can be identified based on their response history. Once identified, embodiments of the present disclosure can encourage and/or induce non-responsive alert responders to be responsive. For example, non-responsive alert responders may be the first alert responders to receive subsequent alert messages. In some embodiments, non-responsive alert responders can be provided with a notification informing them of their non-responsiveness. In some embodiments, non-responsive alert responders can receive subsequent alert messages with an elevated level of responsibility assigned thereto. In some embodiments, snoozing of an alert message can be disabled for non-responsive alert responders. In some embodiments, an ability of a non-responsive alert responder to immediately close an alert message can be disabled. In some embodiments, an ability of a non-responsive alert responder to close an alert message without first providing a qualifying note can be disabled. In some embodiments, an ability of a non-responsive alert responder to close an alert message can be disabled unless the action of closing the message is within an alert-merging logic (e.g., content of the alert message is merged into a different alert message before its closing). In some embodiments, delegating or reassigning an alert message to another alert responders can be disabled.

Further, embodiments herein can determine when a non-responsive alert responder is no longer non-responsive. For example, after being identified as non-responsive, an alert responder can have this label removed after one or more satisfactory responses to one or more alert messages. Thereafter, the alert responder may be regarded by embodiments herein as a "responsive" alert responder (e.g., until again identified as non-responsive).

As referred to herein, the term "monitoring source" can refer to a virtual computing instance (VCI), which covers a range of computing functionality. VCIs may include non-virtualized physical hosts, virtual machines (VMs), and/or containers. A VM refers generally to an isolated end user space instance, which can be executed within a virtualized environment. Other technologies aside from hardware virtualization can provide isolated end user space instances may also be referred to as VCIs. The term "VCI" covers these examples and combinations of different types of VCIs, among others. VMs, in some embodiments, operate with their own guest operating systems on a host using resources of the host virtualized by virtualization software (e.g., a hypervisor, virtual machine monitor, etc.).

Multiple VCIs can be configured to be in communication with each other in a software defined data center. In such a system, information can be propagated from an end user to at least one of the VCIs in the system, between VCIs in the system, and/or between at least one of the VCIs in the system and a management server. In some embodiments, the monitoring server can be provided as a VCI. Software defined data centers are dynamic in nature. For example, VCIs and/or various application services, may be created, used, moved, or destroyed within the software defined data center. When VCIs are created, various processes and/or services start running and consuming resources. As used herein, "resources" are physical or virtual components that have a finite availability within a computer or software defined data center. For example, resources include processing resources, memory resources, electrical power, and/or input/output resources.

The present disclosure is not limited to particular devices or methods, which may vary. The terminology used herein is for the purpose of describing particular embodiments, and is not intended to be limiting. As used herein, the singular forms "a", "an", and "the" include singular and plural referents unless the content clearly dictates otherwise. Furthermore, the words "can" and "may" are used throughout this application in a permissive sense (i.e., having the potential to, being able to), not in a mandatory sense (i.e., must). The term "include," and derivations thereof, mean "including, but not limited to."

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2. A group or plurality of similar elements or components may generally be referred to herein with a single element number. For example a plurality of reference elements 104-1, 104-2, . . . , 104-N may be referred to generally as 104. As will be appreciated, elements shown in the various embodiments herein can be added, exchanged, and/or eliminated so as to provide a number of additional embodiments of the present disclosure. In addition, as will be appreciated, the proportion and the relative scale of the elements provided in the figures are intended to illustrate certain embodiments of the present disclosure, and should not be taken in a limiting sense.

FIG. 1 is a diagram of an example of an infrastructure for encouraging alert responsiveness according to the present disclosure. For example, FIG. 1 can be a diagram of a host 108 for encouraging alert responsiveness according to the present disclosure. The host 108 can include processing resources 112 (e.g., a number of processors), memory resources 114, and/or a network interface 116. Memory resources 114 can include volatile and/or non-volatile memory. Volatile memory can include memory that depends upon power to store information, such as various types of dynamic random access memory (DRAM) among others. Non-volatile memory can include memory that does not depend upon power to store information. Examples of non-volatile memory can include solid state media such as flash memory, electrically erasable programmable read-only memory (EEPROM), phase change random access memory (PCRAM), magnetic memory, optical memory, and/or a solid state drive (SSD), etc., as well as other types of machine-readable media. For example, the memory resources 114 may comprise primary and/or secondary storage.

The host 108 can be included in a software defined data center. A software defined data center can extend virtualization concepts such as abstraction, pooling, and automation to data center resources and services to provide information technology as a service (ITaaS). In a software defined data center, infrastructure, such as networking, processing, and security, can be virtualized and delivered as a service. A software defined data center can include software defined networking and/or software defined storage. In some embodiments, components of a software defined data center can be provisioned, operated, and/or managed through an application programming interface (API).

The host 108 can incorporate a hypervisor 110 that can execute a number of VCIs 104-1, 104-2, . . . , 104-N that can each provide the functionality of a monitoring source. As such, the VCIs may be referred to herein as "monitoring sources." The monitoring sources 104-1, 104-2, . . . , 104-N are referred to generally herein as "monitoring sources 104." The monitoring sources 104 can be provisioned with processing resources 112 and/or memory resources 114 and can communicate via the network interface 116. The processing resources 112 and the memory resources 114 provisioned to the servers 104 can be local and/or remote to the host 108. For example, in a software defined data center, the monitoring sources 104 can be provisioned with resources that are generally available to the software defined data center and are not tied to any particular hardware device. By way of example, the memory resources 114 can include volatile and/or non-volatile memory available to the monitoring sources 104. The monitoring sources 104 can be moved to different hosts (not specifically illustrated), such that different hypervisors manage the monitoring sources 104. In some embodiments, a monitoring source among the number of monitoring sources can be a master monitoring source. For example, monitoring sources 104-1 can be a master monitoring sources, and monitoring sources 104-2, . . . , 104-N can be slave monitoring sources. In some embodiments, each monitoring sources 104 can include a respective logging agent 105-1, 105-2, . . . , 105-N (referred to generally herein as logging agents 105) deployed thereon.

In some embodiments, each the monitoring sources 104 can provide a same functionality. In some embodiments, one or more of the monitoring sources 104 can provide a different functionality than another of the one or more monitoring sources 104. For example, one or more of the monitoring sources 104 can provide email functionality. In some embodiments, one or more of the monitoring sources 104 are configured to selectively permit client login. In some embodiments, one or more of the monitoring sources 104 are email monitoring sources. In some embodiments, one or more of the monitoring sources 104 are application monitoring sources. In a number of embodiments, one or more of the monitoring sources 104 can be servers, such as files servers, print servers, communication servers (such as email), remote access servers, firewalls, etc.), application servers, database servers, web servers, and others. Embodiments herein are not intended to limit the monitoring sources 104 to a particular type and/or functionality.

The monitoring sources 104 can each record and/or maintain a respective event log (herein referred to as a "log") which tracks events (e.g., actions, and/or activities) taking place on the respective monitoring source. The logs can be recorded in real time, for instance. In some embodiments, the logs can track aspects of a number of applications and/or programs. In some embodiments, the logs can track physical and/or virtual hardware usage.

Events in the logs can be accompanied by event information. Event information included in each of the logs can include, for instance, a timestamp of an event, a source of the event (e.g., a particular UI), text associated with the event, and/or a name-value pair extracted from the event. Particular events can cause the triggering of alerts which can be communicated as alert messages. In some embodiments, alert messages can be displayed by a user interface associated with the monitoring server 102. In some embodiments, a client device (e.g., a computing device) can pull alert messages from the monitoring server 102. In some embodiments, the monitoring server 102 can push alert messages to a client device (e.g., a device associated with an alert responder). Thus, alert messages can be received and/or retrieved. An alert message can indicate an alert instance. An alert message can indicate a plurality of alert instances. As previously discussed, an alert instance is a single instance of an alert. An alert instance can be an event that calls for human involvement. In some embodiments, an alert instance can be an event that calls for involvement by artificial intelligence, software agent(s), and/or computer algorithm (s). An alert message indicating an alert instance can include a timestamp of the instance, a source of the instance, text associated with the alert instance, and/or a name-value pair. Alert messages can be provided via a user interface, for instance. Alert messages can be provided via text message (e.g., short message service (SMS)). Alert messages can be provided as push notifications. Alert messages can be provided via email. Embodiments herein do not limit the provision of alert messages to a particular manner.

Alert instances can be defined in part by a class to which they belong. For instance, a first class of alerts can include one or more alert instances of a first type. A second class of alerts can include one or more alert instances of a second type.

In some embodiments, responding to an alert message can include creating and/or associating a note containing text (e.g., a threshold-exceeding amount of text) with the alert instance. In some embodiments, responding to an alert message can include creating and/or associating a note containing an external link with the alert instance. In some embodiments, responding to an alert message can include performing at least one search query associated with the alert instance. In some embodiments, responding to an alert can include performing a remediation action associated with the alert message, such as rebooting an impacted virtual machine that was the subject and/or cause of the alert message.

Notes may include information relevant to the resolution of the alert instance (herein referred to as "resolution information"). In some embodiments, resolution information can include a list of prescribed steps used to resolve the alert instance (sometimes referred to herein as a "solution" to the alert instance). In some embodiments, resolution information may not include a solution, but may include information relating to a resolution of an alert instance. For example, resolution information can include insights, contextual information, questions, announcements, tips, hints, observations, questions, and others.

In some embodiments, responding to an alert message can include creating and/or associating a note containing resolution information with the alert instance. In some embodiments, responding to an alert message can include creating and/or associating a note containing resolution information with a class of alerts to which the alert instance belongs. In some embodiments, the association can be made responsive to an input (e.g., the selection of a selectable display element). The resolution information can be stored in association with the class of alerts via the monitoring server 102.

A response to an alert message can be retrieved from storage. The storage can be provided by a storage functionality in communication with the monitoring server 102. In some embodiments, the storage functionality can be provided by the memory resources 114 (e.g., if the monitoring server 102 is on a same virtualization host 110 as the monitoring sources 104). The retrieved response can be provided by a user interface (e.g., a display) of the monitoring server 102.

Figure 2:
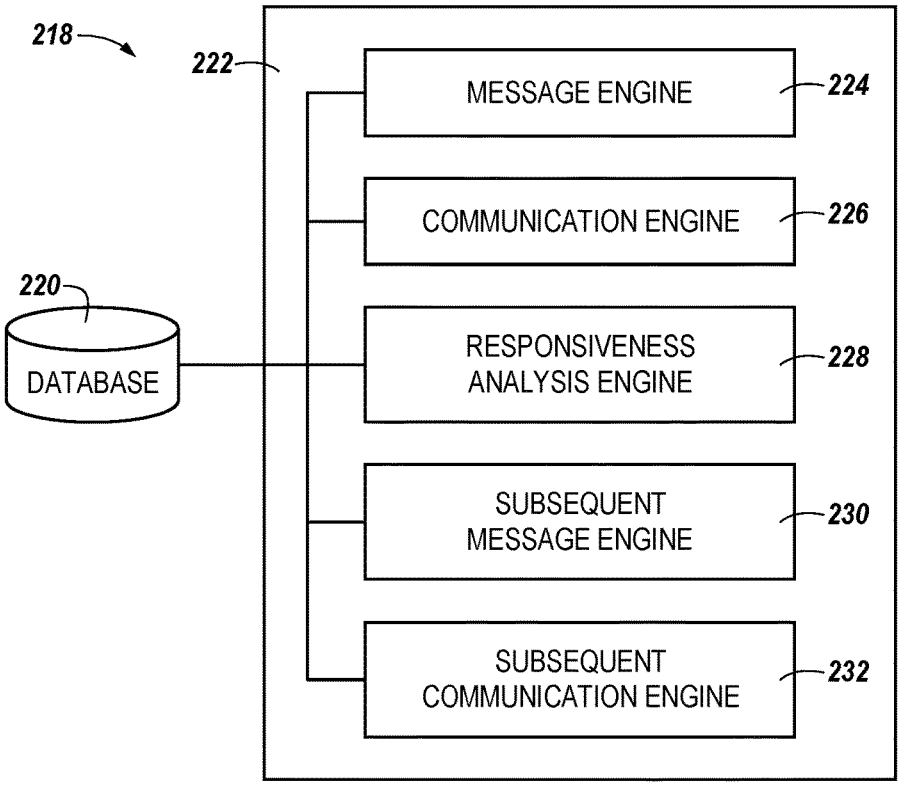
FIG. 2 is a diagram of a general logical system structure implementing the encouragement of alert responsiveness according to the present disclosure.

FIG. 2 is a diagram of a general logical system structure implementing the encouragement of alert responsiveness according to the present disclosure. For example, FIG. 2 can be a diagram of a system for encouraging alert responsiveness according to the present disclosure. The system shown in FIG. 2 can be implemented in a monitoring server, for instance, such as the monitoring server 102, previously discussed.

The system 218 can include a database 220, a subsystem 222, and/or a number of engines, for example a message engine 224, a communication engine 226, a responsiveness analysis engine 228, a subsequent message engine 230, and/or a subsequent communication engine 232, and can be in communication with the database 220 via a communication link. The system 218 can include additional or fewer engines than illustrated to perform the various functions described herein. The system 218 can represent program instructions and/or hardware of a machine (e.g., machine 334 as referenced in FIG. 3, etc.). As used herein, an "engine" can include program instructions and/or hardware, but at least includes hardware. Hardware is a physical component of a machine that enables it to perform a function. Examples of hardware can include a processing resource (e.g., a processor), a memory resource, a logic gate, etc.

The number of engines (e.g., 224, 226, 228, 230, 232) can include a combination of hardware and program instructions that are configured to perform a number of functions described herein. The program instructions (e.g., software, firmware, etc.) can be stored in a memory resource (e.g., machine-readable medium) as well as hard-wired program (e.g., logic). Hard-wired program instructions (e.g., logic) can be considered as both program instructions and hardware.

In some embodiments, the message engine 224 can include a combination of hardware and program instructions that can be configured to receive an alert message via a monitoring server, wherein the alert message indicates an alert instance. In some embodiments, alert messages can be displayed by a user interface associated with the monitoring server.

In some embodiments, the communication engine 226 can include a combination of hardware and program instructions that can be configured to communicate the alert message to a plurality of alert responders. In some embodiments, a client device (e.g., a computing device) associated with one or more alert responders can pull alert messages from the monitoring server. In some embodiments, the monitoring server can push alert messages to a client device. Alert messages can be communicated via text message (e.g., short message service (SMS)). Alert messages can be communicated as push notifications. Alert messages can be communicated via email. Embodiments herein do not limit the provision or communication of alert messages to a particular manner.

In some embodiments, the responsiveness analysis engine 228 can include a combination of hardware and program instructions that can be configured to determine that a non-responsiveness, corresponding to the alert message, of a particular alert responder exceeds a threshold. In some embodiments, the non-responsiveness of the particular alert responder exceeds the threshold based on a failure of the particular alert responder to respond to the alert message and a previous alert message immediately preceding the alert message. In some embodiments, the non-responsiveness of the particular alert responder exceeds the threshold based on a failure of the particular alert responder to respond to the alert message and a predefined quantity of previous alert messages or a quantity of alert messages received during a particular period of time.

In some embodiments, the non-responsiveness of the particular alert responder exceeds the threshold based on a failure of the particular alert responder to create a note associated with the alert message including at least a particular amount of text. In some embodiments, the non-responsiveness of the particular alert responder exceeds the threshold based on a failure of the particular alert responder to create a note associated with the alert message including an external link. In some embodiments, the non-responsiveness of the particular alert responder exceeds the threshold based on a failure of the particular alert responder to perform at least one search query associated with the alert message.

In some embodiments, the non-responsiveness of the particular alert responder exceeds the threshold based on a quantity of alert messages that the particular alert responder reassigned to one or more other alert responders. Embodiments herein, however, can recognize exceptions in cases of reassigned alert messages where the expertise of the particular alert responder may be lacking. For instance, a first alert responder may have expertise and/or experience in mail server alerts while a second alert responder may have expertise and/or experience in web server alerts. A web server alert reassigned by the first alert responder to the second alert responder may not be identified by embodiments herein as an action causing the first alert responder to be identified as non-responsive.

Embodiments of the present disclosure can determine responsiveness and/or non-responsiveness based on more than quantities of alert messages responded to or not responded to over a period of time. For instance, in some embodiments, the level of difficulty or complexity involved in responding to a particular alert can be determined. In some embodiments, a time commitment involved in responding to a particular alert instance or alert class can be determined. For example, time commitment(s) can be determined based on average time(s), taken to respond to previous alert messages belonging to a particular class. Such determinations can allow embodiments herein to determine responsiveness and/or non-responsiveness in alert responders. For example, resetting a mail user's password as a response to a first alert may be less complex and may thus involve a lesser time commitment than reconfiguring an entire mail server. Accordingly, embodiments herein can determine difficulties, complexities, time commitments, and other parameters associated with responding to alerts and determine alert responsiveness based on the relative weights of those parameters.

In some embodiments, the subsequent message engine 230 can include a combination of hardware and program instructions that can be configured to receive a subsequent alert message via the monitoring server, wherein the subsequent alert message indicates a subsequent alert instance. The subsequent alert message can be received in a manner analogous to the reception of the alert message, for instance, though embodiments herein are not so limited.

In some embodiments, the subsequent communication engine 232 can include a combination of hardware and program instructions that can be configured to communicate the subsequent alert message to the particular alert responder having the threshold-exceeding non-responsiveness, wherein the communication of the subsequent alert message includes a response encouragement. The response encouragement can be selected to encourage and/or induce the non-responsive alert responder to respond to the subsequent alert (or the subsequent alert and other subsequent alerts). For instance, the subsequent communication engine 232 can include a combination of hardware and program instructions that can be configured to communicate the subsequent alert message to the particular alert responder with a score corresponding to the determined non-responsiveness. The score can apprise the particular alert responder that his or her non-responsiveness has been determined. The score can apprise the particular alert responder of a particular level or degree of his or her non-responsiveness. Stated another way, embodiments herein can place an alert responder "on notice" that they have been determined to be non-responsive. Such notification may encourage future responsiveness in some cases. After the non-responsive alert responder receives the score (or other notification indicating non-responsiveness), embodiments of the present disclosure can determine changes in the responder's behavior. In some cases, an increased speed of reacting to one or more subsequent alert messages can allow the alert responder to be re-identified as responsive.

The subsequent communication engine 232 can include a combination of hardware and program instructions that can be configured to assign to the particular alert responder an elevated level of responsibility for the subsequent alert message. For instance, the particular alert responder can be solely responsible for responding to the subsequent alert message.

In some embodiments, the subsequent communication engine 232 can include a combination of hardware and program instructions that can be configured to communicate the subsequent alert message to one or more non-responsive alert responders (e.g., a first alert responder) and to one or more responsive alert responders (e.g., a second alert responder). In some embodiments, the subsequent alert message can be communicated to the first alert responder with a first set of response rules and the subsequent alert message can be communicated to the second alert responder with a second set of response rules.

In some embodiments, communicating the subsequent alert message with the first set of rules includes causing a manager of the first alert responder to be notified based on a period of inaction time (e.g., 10 minutes) elapsing before response to the subsequent alert message by the first alert responder, and communicating the subsequent alert message with the second set of rules includes causing a manager of the second alert responder not to be notified based on the period of inaction time elapsing before response to the subsequent alert message by the second alert responder. The period of inaction time can be determined based on user input or automatically (e.g., without user input).

In some embodiments, communicating the subsequent alert message with the first set of rules includes disabling snoozing of the subsequent alert message by the first alert responder, and communicating the subsequent alert message with the second set of rules includes allowing snoozing of the subsequent alert message by the second alert responder. In some embodiments, communicating the subsequent alert message with the first set of rules includes disabling an ability of the first alert responder to close the subsequent alert message during a period of time following the communication of the subsequent alert message, and communicating the subsequent alert message with the second set of rules includes allowing an ability of the second alert responder to close the subsequent alert message during the period of time following the communication of the subsequent alert message. The period of time following the communication can be determined based on user input or automatically.

In some embodiments, communicating the subsequent alert message with the first set of rules includes disabling an ability of the first alert responder to close the subsequent alert message before creating a qualifying note associated with the subsequent alert message made by the first alert responder, and communicating the subsequent alert message with the first set of rules includes allowing an ability of the second alert responder to close the subsequent alert message before creating a qualifying note associated with the subsequent alert message made by the first alert responder. A qualifying note can include a threshold-exceeding amount of text and/or external hyperlink, for example.

Figure 3:
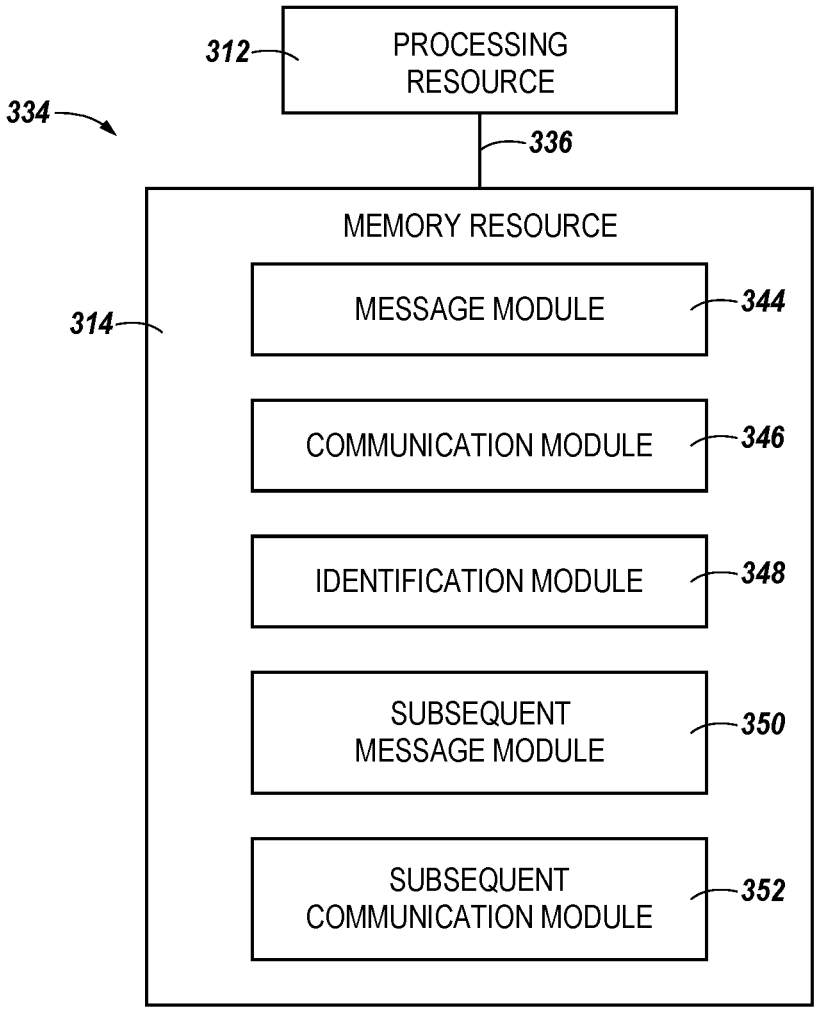
FIG. 3 is a diagram of an example system structure implementing the encouragement of alert responsiveness according to the present disclosure.

FIG. 3 is a diagram of an example system structure implementing the encouragement of alert responsiveness according to the present disclosure. For example, FIG. 3 can be a diagram of a machine for encouraging alert responsiveness according to the present disclosure. The machine 334 can utilize software, hardware, firmware, and/or logic to perform a number of functions. The machine 334 can be a combination of hardware and program instructions configured to perform a number of functions (e.g., actions). The hardware, for example, can include a number of processing resources 312 and a number of memory resources 314, such as a machine-readable medium (MRM) or other memory resources 314. The memory resources 314 can be internal and/or external to the machine 334 (e.g., the machine 334 can include internal memory resources and have access to external memory resources). The program instructions (e.g., machine-readable instructions (MRI)) can include instructions stored on the MRM to implement a particular function (e.g., an action such as identifying an alert responder as non-responsive). The set of MRI can be executable by one or more of the processing resources 312. The memory resources 314 can be coupled to the machine 334 in a wired and/or wireless manner. For example, the memory resources 314 can be an internal memory, a portable memory, a portable disk, and/or a memory associated with another resource, e.g., enabling MRI to be transferred and/or executed across a network such as the Internet. As used herein, a "module" can include program instructions and/or hardware, but at least includes program instructions.

The memory resources 314 can be non-transitory and can include volatile and/or non-volatile memory. Volatile memory can include memory that depends upon power to store information, such as various types of dynamic random access memory (DRAM) among others. Non-volatile memory can include memory that does not depend upon power to store information. Examples of non-volatile memory can include solid state media such as flash memory, electrically erasable programmable read-only memory (EEPROM), phase change random access memory (PCRAM), magnetic memory, optical memory, and/or a solid state drive (SSD), etc., as well as other types of machine-readable media.

The processing resources 312 can be coupled to the memory resources 314 via a communication path 336. The communication path 336 can be local or remote to the machine 334. Examples of a local communication path 336 can include an electronic bus internal to a machine, where the memory resources 314 are in communication with the processing resources 312 via the electronic bus. Examples of such electronic buses can include Industry Standard Architecture (ISA), Peripheral Component Interconnect (PCI), Advanced Technology Attachment (ATA), Small Computer System Interface (SCSI), Universal Serial Bus (USB), among other types of electronic buses and variants thereof. The communication path 336 can be such that the memory resources 314 are remote from the processing resources 312, such as in a network connection between the memory resources 314 and the processing resources 312. That is, the communication path 336 can be a network connection. Examples of such a network connection can include a local area network (LAN), wide area network (WAN), personal area network (PAN), and the Internet, among others.

As shown in FIG. 3, the MRI stored in the memory resources 314 can be segmented into a number of modules 344, 346, 348, 350, 352 that when executed by the processing resources 312 can perform a number of functions. As used herein a module includes a set of instructions included to perform a particular task or action. The number of modules 344, 346, 348, 350, 352 can be sub-modules of other modules. For example, the subsequent message module 352 can be a sub-module of the message module 344 and/or can be contained within a single module. Furthermore, the number of modules 344, 346, 348, 350, 352 can comprise individual modules separate and distinct from one another. Examples are not limited to the specific modules 344, 346, 348, 350, 352 illustrated in FIG. 3.

Each of the number of modules 344, 346, 348, 350, 352 can include program instructions and/or a combination of hardware and program instructions that, when executed by a processing resource 312, can function as a corresponding engine as described with respect to FIG. 2. For example, the message module 344 can include program instructions and/or a combination of hardware and program instructions that, when executed by a processing resource 312, can function as the message engine 224, the communication module 346 can include program instructions and/or a combination of hardware and program instructions that, when executed by a processing resource 312, can function as the communication engine 226, the identification module 348 can include program instructions and/or a combination of hardware and program instructions that, when executed by a processing resource 312, can function as the responsiveness analysis engine 228, the subsequent message module 350 can include program instructions and/or a combination of hardware and program instructions that, when executed by a processing resource 312, can function as the subsequent message engine 230, and/or the subsequent communication module 352 can include program instructions and/or a combination of hardware and program instructions that, when executed by a processing resource 312, can function as the subsequent communication engine 226.

In some embodiments, the identification module 348 can include program instructions and/or a combination of hardware and program instructions that, when executed by a processing resource 312, cause the processing resource 312 to identify a first alert responder as a responsive alert responder based on a response history of the first alert responder during a first period of time, and identify a second alert responder as a non-responsive alert responder based on a response history of the second alert responder during the first period of time.

Some embodiments include instructions to identify the first alert responder as the responsive alert responder based on a quantity of the plurality of alert messages for which the first alert responder made qualifying notes exceeding a quantity threshold, and identify the second alert responder as the non-responsive alert responder based on a quantity of the plurality of alert messages for which the second alert responder made qualifying notes not exceeding the quantity threshold.

Some embodiments include instructions to identify the first alert responder as the responsive alert responder based on a proportion of the plurality of alert messages for which the first alert responder made qualifying notes exceeding a proportion threshold, and identify the second alert responder as the non-responsive alert responder based on a proportion of the plurality of alert messages for which the second alert responder made qualifying notes not exceeding the proportion threshold.

In some embodiments, the subsequent alert message can be communicated to the second alert responder at a first time and first alert responder at a second (e.g., later) time. In some embodiments, the second alert responder can be notified that the second alert responder is the only alert responder of the plurality of alert responders to receive the communication of the subsequent alert message. In some embodiments, subsequent alert message is communicated to the second alert responder and the first alert responder at a same time, and a notification is communicated to the first alert responder to delay responding to the subsequent alert message for a period of time. In some embodiments, such a notification can indicate to the alert responder that they can (or have the option to) delay responding to the subsequent alert message for a period of time. Such a period of time may be selected in order to allow the second alert responder time to respond to the subsequent alert message. In some embodiments, the subsequent alert message can be communicated to the first alert responder using a first visual indicator and communicated to the second alert responder using a second visual indicator. Visual indicators can include colors, for instance. In some embodiments, for example, the subsequent alert message can be communicated to the first alert responder using a first color (e.g., green) and to the second alert responder using a second color (e.g., red). Visual indicators are not intended to be limited to colors; rather, visual indicators can include, for example, icons, textual indicators, etc.

As previously discussed, embodiments of the present disclosure can re-identify non-responsive alert responders as responsive. For instance, in some embodiments, the identification of the second alert responder can be modified from non-responsive based on a response history of the second alert responder during a second period of time (including the receipt of the subsequent alert message). Alert messages received subsequent to the modification of the identification of the alert responder can be treated as being communicated to a responsive alert responder, for instance. In some embodiments, another subsequent alert message can be received via the monitoring server during a third period of time, wherein the other subsequent alert message indicates another subsequent alert instance. The other subsequent alert message can be communicated to the plurality of alert responders.

Figure 4:
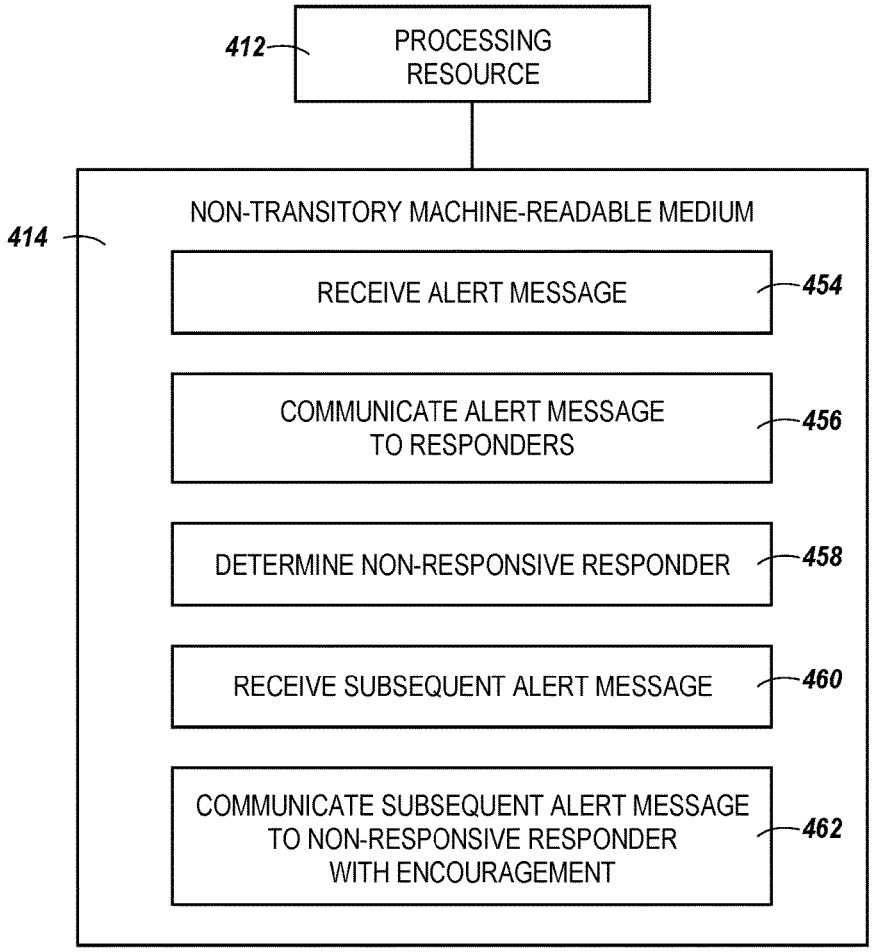
FIG. 4 illustrates a diagram of a non-transitory machine-readable medium for encouraging alert responsiveness according to the present disclosure.

FIG. 4 illustrates a diagram of a non-transitory machine-readable medium for encouraging alert responsiveness according to the present disclosure. The medium 414 can be part of a machine that includes a processing resource 412. The processing resource 412 can be configured to execute instructions stored on the non-transitory machine readable medium 414. For example, the non-transitory machine readable medium 414 can be any type of volatile or non-volatile memory or storage, such as random access memory (RAM), flash memory, read-only memory (ROM), storage volumes, a hard disk, or a combination thereof. When executed, the instructions can cause the processing resource 412 to provide alert responsiveness.

The medium 414 can store instructions 454 executable by the processing resource 412 to receive an alert message via a monitoring server, wherein the alert message indicates an alert instance. The medium 414 can store instructions 456 executable by the processing resource 412 to communicate the alert message to a plurality of alert responders. The medium 414 can store instructions 458 executable by the processing resource 412 to determine that a non-responsiveness, corresponding to the alert message, of a particular alert responder exceeds a threshold. The medium 414 can store instructions 460 executable by the processing resource 412 to receive a subsequent alert message via the monitoring server, wherein the subsequent alert message indicates a subsequent alert instance. The medium 414 can store instructions 462 executable by the processing resource 412 to communicate the subsequent alert message to the particular alert responder having the threshold-exceeding non-responsiveness, wherein the communication of the subsequent alert message includes a response encouragement.

FIG. 5 is an interface associated with encouraging alert responsiveness according to the present disclosure. The interface 564 can be provided (e.g., displayed) by a management server and/or a client device as described herein, for instance. The interface 564 can be used by one or more alert responders for use in responding to alert messages.

The interface 564 includes a plurality of indicators associated with alert messages; for instance, the interface includes an alert message 566-1, an alert message 566-2, and an alert message 566-3 (cumulatively referred to as "alert messages 566"). For each alert message, information can be displayed via the interface 564.

An "opened on" column 570 can include information indicating when the alert messages 566 were received (e.g., via an alert management server/module and/or incident management server/module). A "status" column 568 can include information regarding a status of each of the alert messages 566. In some embodiments, status can include "resolved," "open," "triggered," "acknowledged," "responded to," "unresolved," "not responded to," "unopened," "snoozed," "closed," etc. In some embodiments, a "view" bar 580 can allow the selection and/or sorting of a subset of the plurality of alert messages corresponding to one or more statuses. A "details" column 572 can include information describing each of the alert messages 566 (e.g., the alerts indicated by the alert messages 566). A "type" column 573 can indicate a type of each of the alert messages 566. In some embodiments, the type 573 may refer to a class of alert messages to which particular alert messages 566 belong. A "domain" column 574 can include information regarding a domain to which each of the alert messages 566 belong or from which each of the alert messages 566 originated. An "assigned to" column 576 can include name(s) of particular alert responders to which one or more of the alert messages 566 have been specifically assigned for response. A "duration" column 578 can include a respective duration that each of the alert messages 566 was, or is still, unresolved (e.g., not marked "resolved"). time and/or date which each of the alert messages 566 was resolved.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Various advantages of the present disclosure have been described herein, but embodiments may provide some, all, or none of such advantages, or may provide other advantages.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A non-transitory, machine-readable medium having instructions stored thereon which, when executed by a processor, cause the processor to:

receive an alert message from a monitoring server, wherein the alert message indicates an alert instance;

communicate the alert message to a plurality of alert responders, the plurality of alert responders comprising a first alert responder and a second alert responder;

determine that a non-responsiveness, corresponding to the alert message, of the first alert responder exceeds a threshold;

receive a subsequent alert message via the monitoring server, wherein the subsequent alert message indicates a subsequent alert instance; and communicate the subsequent alert message to the first and second alert responders, wherein the subsequent alert message is communicated to the first alert responder with a first set of response rules and to the second alert responder with a second set of response rules.

2. The medium of claim 1, wherein executing the instructions further causes the processor to determine that the non-responsiveness of the first alert responder exceeds the threshold based on a failure of the first alert responder to respond to the alert message and a predefined quantity of previous alert messages.

3. The medium of claim 1, wherein executing the instructions further causes the processor to determine that the non-responsiveness of the first alert responder exceeds the threshold based on a failure of the first alert responder to:

create a note associated with the alert message including at least a particular amount of text;

create a note associated with the alert message including an external link;

perform a remediation action associated with the alert message; or perform at least one search query associated with the alert message.

4. The medium of claim 1, wherein executing the instructions further causes the processor to determine that the non-responsiveness of the first alert responder exceeds the threshold based on a failure of the first alert responder to respond to the alert message and a quantity of previous alert messages preceding the alert message during a particular period of time.

5. The medium of claim 1, wherein executing the instructions further causes the processor to communicate the subsequent alert message to the first alert responder with a score corresponding to the determined non-responsiveness.

6. The medium of claim 1, wherein executing the instructions further causes the processor to assign to the first alert responder an elevated level of responsibility for the subsequent alert message.

7. A method for encouraging alert responsiveness, comprising:

receiving an alert message via a monitoring server, wherein the alert message indicates an alert instance;

communicating the alert message to a first alert responder and a second alert responder;

determining that a non-responsiveness of the first alert responder corresponding to the alert message exceeds a threshold;

receiving a subsequent alert message via the monitoring server, wherein the subsequent alert message indicates a subsequent alert instance; and communicating the subsequent alert message to the first and second alert responders, wherein the subsequent alert message is communicated to the first alert responder with a first set of response rules and the subsequent alert message is communicated to the second alert responder with a second set of response rules.

8. The method of claim 7, wherein:

communicating the subsequent alert message with the first set of rules includes causing a third alert responder having an escalation level exceeding an escalation level of the first alert responder and second alert responder to be notified based on a period of inaction time elapsing before response to the subsequent alert message by the first alert responder; and communicating the subsequent alert message with the second set of rules includes causing the third alert responder not to be notified based on the period of inaction time elapsing before response to the subsequent alert message by the second alert responder.

9. The method of claim 7, wherein:

communicating the subsequent alert message with the first set of rules includes disabling snoozing of the subsequent alert message by the first alert responder; and communicating the subsequent alert message with the second set of rules includes allowing snoozing of the subsequent alert message by the second alert responder.

10. The method of claim 7, wherein:

communicating the subsequent alert message with the first set of rules includes disabling an ability of the first alert responder to close the subsequent alert message during a period of time following the communication of the subsequent alert message; and communicating the subsequent alert message with the second set of rules includes allowing an ability of the second alert responder to close the subsequent alert message during the period of time following the communication of the subsequent alert message.

11. The method of claim 7, wherein:

communicating the subsequent alert message with the first set of rules includes disabling an ability of the first alert responder to close the subsequent alert message before creating a qualifying note associated with the subsequent alert message made by the first alert responder; and communicating the subsequent alert message with the first set of rules includes allowing an ability of the second alert responder to close the subsequent alert message before creating a qualifying note associated with the subsequent alert message made by the first alert responder.

12. A system for encouraging alert responsiveness, comprising:

a processing resource; and a memory resource configured to store instructions which, when executed by the processing resource, cause the processing resource to:

receive a plurality of alert messages via a monitoring server during a first period of time, wherein each alert message indicates a respective alert instance;

communicate each alert message to each of a plurality of alert responders, wherein the plurality of alert responders includes a first alert responder and a second alert responder;

identify the first alert responder as a responsive alert responder based on a response history of the first alert responder during the first period of time;

identify the second alert responder as a non-responsive alert responder based on a response history of the second alert responder during the first period of time;

receive a subsequent alert message via the monitoring server during a second period of time, wherein the subsequent alert message indicates a subsequent alert instance; and communicate the subsequent alert message to the plurality of alert responders.

13. The system of claim 12, including instructions to:

identify the first alert responder as the responsive alert responder based on a quantity of the plurality of alert messages for which the first alert responder made qualifying notes exceeding a quantity threshold; and identify the second alert responder as the non-responsive alert responder based on a quantity of the plurality of alert messages that the second alert responder reassigned to any of the plurality of alert responders.

14. The system of claim 12, including instructions to:

identify the first alert responder as the responsive alert responder based on a quantity of the plurality of alert messages for which the first alert responder made qualifying notes exceeding a quantity threshold; and identify the second alert responder as the non-responsive alert responder based on a quantity of the plurality of alert messages for which the second alert responder made qualifying notes not exceeding the quantity threshold.

15. The system of claim 12, including instructions to:

identify the first alert responder as the responsive alert responder based on a proportion of the plurality of alert messages for which the first alert responder made qualifying notes exceeding a proportion threshold; and identify the second alert responder as the non-responsive alert responder based on a proportion of the plurality of alert messages for which the second alert responder made qualifying notes not exceeding the proportion threshold.

16. The system of claim 12, including instructions to:

communicate the subsequent alert message to the second alert responder at a first time; and communicate the subsequent alert message to the first alert responder at a second time.

17. The system of claim 16, including instructions to notify the second alert responder that the second alert responder is the only alert responder of the plurality of alert responders to receive the communication of the subsequent alert message.

18. The system of claim 12, including instructions to:

communicate the subsequent alert message to the second alert responder and the first alert responder at a same time; and communicate a notification to the first alert responder that encourages the first alert responder to delay responding to the subsequent alert message for a period of time.

19. The system of claim 18, including instructions to:

communicate the subsequent alert message to the first alert responder using a first visual indicator; and communicate the subsequent alert message to the second alert responder using a second visual indicator.

20. The system of claim 12, including instructions to modify the identification of the second alert responder from non-responsive to responsive based on a response history of the second alert responder during the second period of time.

21. The system of claim 20, including instructions to:

receive another subsequent alert message via the monitoring server during a third period of time, wherein the other subsequent alert message indicates another subsequent alert instance; and communicate the other subsequent alert message to the plurality of alert responders.

* * * * *